United States Patent [19]

Schnabel, Jr.

[11] Patent Number: 4,480,945

[45] Date of Patent: Nov. 6, 1984

[54] METHOD OF REINFORCING AN EXISTING EARTH SUPPORTING WALL

[75] Inventor: Harry Schnabel, Jr., Bethesda, Md.

[73] Assignee: Schnabel Foundation Company, Bethesda, Md.

[21] Appl. No.: 370,250

[22] Filed: Apr. 20, 1982

[51] Int. Cl.[3] ..... E02D 29/02; E21D 20/02

[52] U.S. Cl. ..... 405/262; 405/260; 405/284

[58] Field of Search ..... 405/31, 258, 260, 262, 405/272, 284, 286

[56] References Cited

U.S. PATENT DOCUMENTS

| | | | |
|---|---|---|---|
| Re. 28,977 | 9/1976 | Mason | 405/262 |
| 1,270,659 | 6/1918 | Ravier | 405/262 |
| 2,902,743 | 9/1959 | King | 249/10 |
| 3,226,933 | 1/1966 | White | 405/262 |
| 3,250,075 | 5/1966 | Webb | 405/262 |
| 3,371,494 | 3/1968 | Lagerstrom | 405/260 |
| 3,490,242 | 1/1970 | Schnabel, Jr. | 405/262 |
| 3,802,204 | 4/1974 | Mason | 405/262 |
| 4,036,026 | 7/1977 | Asayama | 405/262 |
| 4,124,983 | 11/1978 | Weatherby | 405/262 X |
| 4,189,891 | 2/1980 | Johnson et al. | 405/262 X |
| 4,369,004 | 1/1983 | Weatherby | 405/284 X |

FOREIGN PATENT DOCUMENTS

| | | | |
|---|---|---|---|
| 735775 | 6/1980 | U.S.S.R. | 405/258 |

OTHER PUBLICATIONS

Shin Gijutsu Kaihatsu Co., Ltd. (SGK) Brochure "Typical Installations" Brochure–Bethlehem Steel Sheet Piling.

*World Ports/American Seaport,* Dec. 1975, "Port Engineer's Notebook", Schnabel Foundation Company advertisement brochure.

German Language Article Bodenvernagelung.

*Primary Examiner*—Cornelius J. Husar

*Assistant Examiner*—Nancy J. Stodola

*Attorney, Agent, or Firm*—Banner, Birch, McKie & Beckett

[57] ABSTRACT

A method of reinforcing or strengthening an existing earth supporting wall located between a body of water and land is disclosed, wherein the level of the earthen floor adjacent the wall is to be deepened or a portion of the wall has deteriorated. The wall has a first side facing a body of water, an opposite second side in contact with ground and a lower toe portion embedded in the earthen floor beneath the body of water. The method comprises the steps of: installing at least one tieback through the wall in an area adjacent the original level of the earthen floor or adjacent the deteriorated area to provide a stabilizing force to the wall.

7 Claims, 3 Drawing Figures

METHOD OF REINFORCING AN EXISTING EARTH SUPPORTING WALL

TECHNICAL FIELD

The present invention relates to the field of construction wherein bulkheads are used to separate water from land and to provide a dock for large vessels. More particularly, the present invention relates to a method for increasing the strength of an existing bulkhead wall.

BACKGROUND OF THE INVENTION

Numerous types of earth supporting walls or structures such as bulkheads, quay walls, and seawalls have been used to divide a body of water from land. This invention is particularly applicable to bulkheads used as docks, but would apply to strengthening any wall. These supporting walls have been made of various materials, such as wood, metal and concrete. The bottom edge of such a supporting wall is driven or inserted into the earthen floor beneath the body of water. In situations where the water is relatively shallow and the wall fairly short, the driving of the bottom edge of the supporting wall into the earthen floor provides sufficient support for the wall to retain or hold back the ground from the water. However, where the water is deep and the wall is high, additional support for the wall is required. The usual method of providing additional support utilizes a tie rod connected at one of its ends to the wall and at its other end to a deadman. Another method of attaining the additional support is through the use of ground anchors inserted at an angle below horizontal through the wall and into the adjacent ground. The ground anchors are fixed in the ground and also secured to the wall. In either of these cases, the wall is designed to span between the rods and the soil below the water. Thus, the strength of the wall is a limiting factor on the design, as is the depth of the water.

U.S. Pat. No. 2,902,743 to King illustrates a method of constructing a concrete bulkhead. Additional support for the wall of the bulkhead is provided by a plurality of tie-rods or dead-men extending from the bulkhead to an anchor. U.S. Pat. No. 1,270,659 to Ravier illustrates a method of constructing original retaining walls. The retaining walls are constructed either of metal or concrete. Ground anchors are passed through pre-existing holes in the wall members to provide additional support for the wall during the original installation of the wall.

Ground anchors have been used to support retaining walls in various land construction situations, for example, at excavation sites. Such ground anchors are generally formed of rods or tendons received within holes in the ground and fixed to the ground by grout or concrete. The use of typical ground anchors in land construction situations is illustrated in U.S. Pat. No. 3,250,075 to Webb et al; U.S. Pat. No. 3,490,242 to Schnabel, Jr.; and U.S. Pat. No. 3,802,204 to Mason. In all of these cases, the ground anchors are installed from within the excavation, working close to the wall which is accessable.

Once a bulkhead wall is constructed, it determines the maximum depth of the harbor. This is because the wall is designed as a beam spanning between an upper row of rods and the soil below the harbor. Usually, to avoid major construction problems, the upper rods are placed at or near the level of water in the harbor. The other end of the wall is supported by the earth on the harbor side, and below the harbor (the toe support). The exact mechanism of this support is subject to some debate among engineers, but all parties agree that it is the only support for the bottom of the wall. The wall is constructed to provide earth access to deep water, so the earth acts against the wall and it must be designed to span between these two supports and resist the earth pressures on it. Usually, bulkheads are carefully designed for a known harbor depth.

When a dock or harbor is to be dredged, removal of the soil supporting the wall may cause it to fail. The failure may be caused by the wall displacing the remaining soil, or it may be because the span on the wall increased, and it is insufficient for the deeper harbor.

One prior art technique for deepening harbors, is to insert a new wall in front of the original wall, i.e., witin the water, and secure the new wall to the land with tie-rods. To attach the new wall to the tie-rods, the ground behind the original wall must be removed. The tie-rods must then be attached to the new wall and to an anchor located at a relatively large distance from the wall. However, such a repair technique is both time consuming and expensive.

The present invention was developed to provide a simple, less time consuming and less expensive technique for reinforcing existing bulkhead walls which separate a body of water from land. It is an object of the invention to allow the harbor to be dredged deeper and continue to safely use some existing bulkhead walls. The invention allows walls to be strengthened in a way that allows harbor dredging. It can also be used to strengthen any bulkhead wall. This is done by installing tie-rods below the harbor level through the wall.

SUMMARY OF THE INVENTION

The present invention is directed to a method of reinforcing a bulkhead wall. The wall has a first side facing the body of water, an opposite second side in contact with ground and a lower end embedded in the floor beneath the body of water. The method comprises the steps of: drilling beneath the surface of the body of water at least one hole through the existing earth supporting wall, installing a tieback through this hole and into the ground; and securing one end of the tieback to the wall whereby the tieback reinforces the wall.

In a preferred embodiment, the tiebacks are installed below the harbor level so they carry some of the earth load, and particularly reduce the required wall structure, and toe support. In another embodiment, a plurality of the tiebacks are inserted around a deteriorated, i.e., weakened, portion of the existing wall to provide reinforcement in the deteriorated area.

The method of the present invention is less time consuming and less expensive than the technique of inserting a new wall in front of an existing original wall and, thereafter, attaching the new wall to tie-rods. The method of the present invention can be accomplished without either removing earth or holding back water. All of the operative steps of the method can be accomplished underwater, i.e., drilling through the wall and into the ground, and inserting tendons and grout of the tiebacks.

Various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter in which there are illustrated and described several embodiments of the invention.

DETAILED DESCRIPTION OF THE INVENTION

Figure 1:
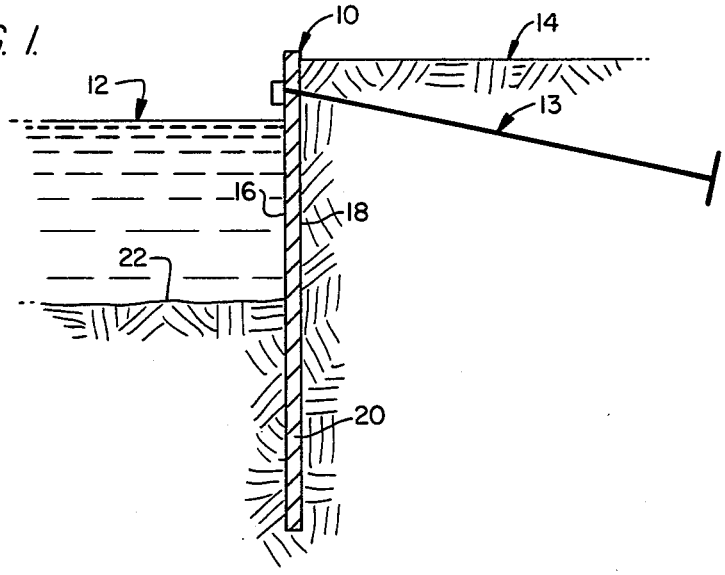
FIG. 1 is a schematic view illustrating an existing bulkhead wall dividing a body of water from land.

Referring to the drawings, wherein like numerals indicate like elements, there is shown in FIG. 1 an existing bulkhead wall 10. On one side of the wall is water 12 and on the other side earth 14. The wall 10 has a water side 16 which faces the water 12 and a land side 18 which faces the earth 14. The function of wall 10 is to separate the land from the water. The lower end 20 of the wall 10, also known as its toe, penetrates below the harbor bottom 22 and has earth on both sides. The wall 10 can be of any conventional type, for example, steel sheet piles, concrete sheet piles, wood, etc. The earth which acts against the wall exerts greater pressure than the water, so to be stable the wall is restrained at the top by rod 13 and at its bottom 20 by its toe penetration below the harbor bottom 22.

Where walls of this type are used as docks, it is customary to design them for a particular elevation of the harbor bottom 22. The earth below bottom 22 must support the lower end of wall 10. Although engineers may differ on the precise details of this support, all agree it is the only support for the lower end 20 of wall 10. Wall 10 must then be designed for the earth pressures acting on side 18, and to span all the way to rods 13. The rods 13 are designed to support the top of wall 10, and to have a capacity based on the earth pressure which must be resisted. Thus, wall 10 is always designed as a beam which is loaded by the earth pressure on side 18, and spans between the rod 13 and some point below the harbor bottom 22, where the earth on side 16 provides adequate support for the lower end 20. Wall 10 must penetrate deep enough below the harbor bottom 22 so that the earth on side 16 will provide the required resistance. Thus, wall 10 is usually designed for a particular depth of the harbor, and the penetration below the harbor bottom 22 and the strength of wall 10 are dependent. It is therefore virtually impossible to deepen a harbor adjacent to such a wall, unless the original design comtemplated the deepening. It is an object of the invention to provide a way of deepening a harbor adjacent to such a wall.

Figure 2:
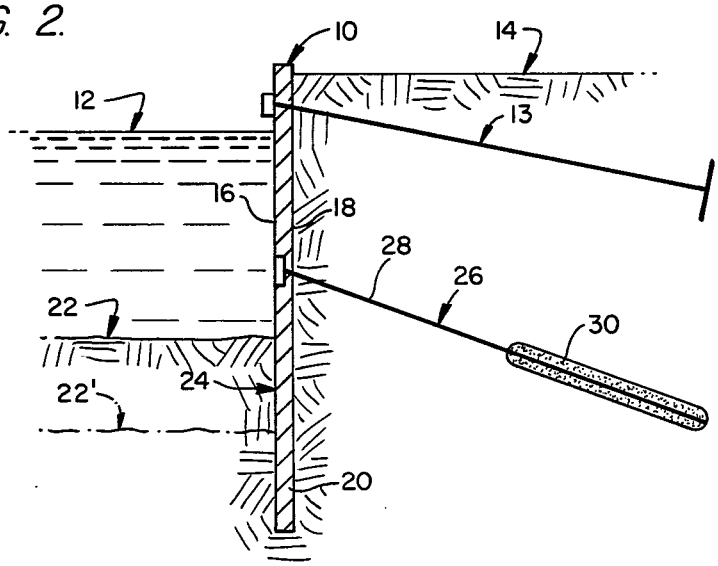
FIG. 2 is a schematic view ilustrating an embodiment of the method of the present invention wherein an existing bulkhead wall is reinforced because the harbor bottom adjacent the wall is to be deepened.

Referring to FIG. 2, a method in accordance with the present invention, of strengthening an existing wall 10, when the harbor bottom 22 is deepened, is illustrated. The original wall 10 was designed and built for a water depth of harbor bottom 22, but it is proposed to lower the harbor bottom to elevation 22'. This will remove some of soil 24 which previously acted on the toe of wall 10 to support its lower end 20. If wall 10 was carefully designed when it was built, this soil 24 is needed for stability. So, one result of the dredging is to remove a portion of the lower support. Because the earth pressure acts on side 18, and is greater then the water pressure on side 16, the dredging also increases the magnitude of these forces. It also increases the span which the wall must be designed for. The wall, which had been designed as a beam, must now be adequate for greater forces and longer span. It usually is not adequate. This invention involves using tiebacks 26 to resist part of these greater forces, and to reduce the span. It is usually necessary to accomplish both results to be able to reuse existing bulkhead walls for greater harbor depths.

To accomplish this strengthening operation, a hole is drilled through the existing wall 10 below the water level, and into the earth behind side 18. Thereafter, a tieback 26, of any conventional design, is inserted at a downwardly sloping angle through the hole in wall 10 and into the earth behind side 18. The tieback 26 is fixed to the earth behind side 18 and attached to wall 10. Typically, tieback 26 is comprised of a tendon 28, which has an end attached to wall 10, and grout 30, which surrounds a portion of tendon 28 in the earth to fix tendon 28 to the earth.

The particular location and number of tiebacks 26 which are used are selected so that wall 10 has sufficient strength and stability to resist the additional earth pressure on side 18 after the harbor bottom is dredged to its new deeper level 22'. Preferably, tiebacks 26 are located so that at least a portion of the tiebacks 26 extend below the new deepened harbor bottom level 22'. While only a sngle tieback 26 is shown in FIG. 2, a number of horizontally spaced tiebacks 26 are used, dependent upon the length of wall 10 which is to be adjacent a deepened harbor.

Figure 3:
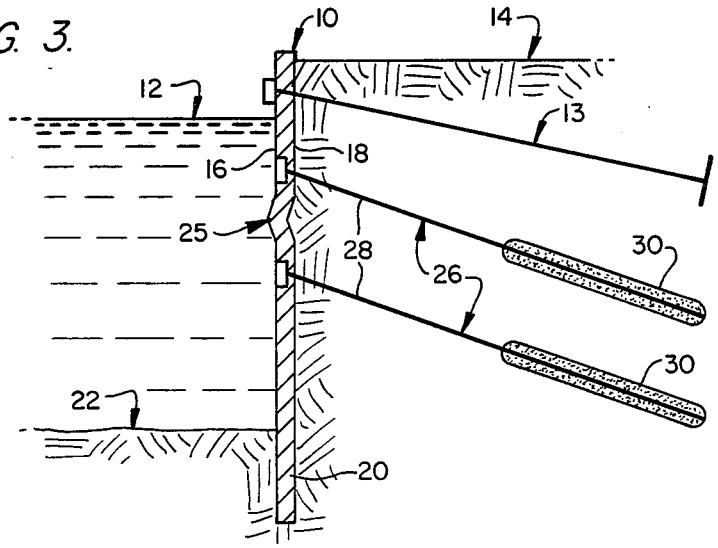
FIG. 3 is a schematic view illustrating a method of strengthening a weakened area of an existing wall in accordance with another embodiment of the present invention.

FIG. 3 illustrates another embodiment of a strengthening method in accordance with the present invention. In FIG. 3, wall 10 has begun to deteriorate, for example, as by cracking in area 25. Wall 10 is thus weakened in area 25 so that earth pressure of the soil behind side 18 may eventually cause wall 10 to buldge outwardly in area 25, even though wall 10 was originally designed to withstand this earth pressure.

As in the first embodiment, wall 10 of FIG. 3 is strengthened by use of tiebacks 26. In this instance tiebacks 26 are located about the weakened area 25 of wall 10. Again, conventional tiebacks 26 comprised of tendons 28 and grout 30 are used. The particular location and number of tiebacks 26 is determined by the type of wall 10 and the extent and location of the weakened area 25. In the example shown in FIG. 3, two vertically spaced tiebacks 26 were used. As with the first embodiment of the invention, this embodiment allows an existing wall 10 to be preserved in a simple and inexpensive manner without the expense of constructing a new replacement wall.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in manner of shape, size, and arrangement of parts within the principle of the invention, to the full extent indicated by the broad general meaning in which the appended claims are expressed.

I claim:

1. A method of reinforcing an original existing bulkhead wall located between a body of water and land, without installing a new wall in front of the bulkhead wall, wherein the original bulkhead wall is designed to support the earth at an orginal earthen floor level and the earthen floor adjacent the bulkhead wall is to be deepened from its original level to a new deeper level which is above the lowermost end of the bulkhead wall, said bulkhead wall having a first side facing the body of water, an opposite second side in contact with ground and a lower toe portion embedded in the earthen floor beneath the body of water, comprising the steps of:

(a) drilling beneath the surface of the water one or more holes through the existing bulkhead wall for the insertion of one or more tiebacks; and (b) installing a sufficient number of tiebacks through the holes drilled in said existing bulkhead wall below the water surface to provide a stabilizing force to the wall sufficient to support the increased earth pressure when the earthen floor level is deepened.

2. A method in accordance with claim 1 wherein said step of installing at least one tieback includes locating said at least one tieback so that at least a portion of said tieback extends below the new deeper level to which the earthen floor is to be deepened.

3. A method in accordance with claim 1 or 2 wherein said step of installing said at least one tieback includes inserting a tendon through said hole, attaching an end of the tendon to the wall, and surrounding at least a portion of the tendon which is in the ground with grout.

4. A method in accordance with claim 1 or 2 wherein the step of installing at least one tieback includes installing a sufficient number of tiebacks to strengthen the wall a sufficient degree to support the increased earth pressure when the earthen floor level is deepened.

5. A method of reinforcing an existing, bulkhead wall located between a body of water and land, without installing a new wall in front of the bulkhead wall, wherein a portion of the bulkhead wall has become weakened, said bulkhead wall having a first side facing the body of water, an opposite second side in contact with ground and a lower toe portion embedded in the earthen floor beneath the body of water, comprising the steps of:

(a) drilling beneath the surface of the water one or more holes through the existing bulkhead wall for the insertion of one or more tiebacks; and, (b) installing a sufficient number of tiebacks through the bulkhead wall in an area adjacent the weakened portion of the bulkhead wall to strengthen the bulkhead wall adjacent its weakened portion a sufficient degree to prevent the failure of the bulkhead wall to support the earth because of the weakened area of the wall.

6. A method in accordance with claim 5 wherein said step of installing said at least one tieback includes inserting a tendon through said hole, attaching an end of the tendon to the wall, and surrounding at least a portion of the tendon which is in the ground with grout.

7. A method in accordance with claim 5 or 6 wherein the step of installing at least one tieback includes installing a sufficient number of tiebacks to strengthen the wall a sufficient degree to prevent the failure of the wall to support the earth because of the weakened area of the wall.

* * * * *